US012419401B1

(12) United States Patent
Johnson et al.

(10) Patent No.: US 12,419,401 B1
(45) Date of Patent: Sep. 23, 2025

(54) LUGGAGE DOLLY FOR SUPPORTING AND MOVING A LUGGAGE ARTICLE, SUCH AS A DUFFEL BAG, AND A METHOD THEREFOR

(71) Applicant: Dream Dollie LLC, Saint Michael, MN (US)

(72) Inventors: Barbara Johnson, Saint Michael, MN (US); Elyssa Danahy, Saint Michael, MN (US)

( * ) Notice: Subject to any disclaimer, the term of this patent is extended or adjusted under 35 U.S.C. 154(b) by 0 days.

(21) Appl. No.: 19/040,569

(22) Filed: Jan. 29, 2025

(51) Int. Cl.
*A45C 13/36* (2006.01)
*A45C 3/00* (2006.01)
*A45C 13/38* (2006.01)

(52) U.S. Cl.
CPC ..... *A45C 13/385* (2013.01); *A45C 3/00* (2013.01); *A45C 13/36* (2013.01)

(58) Field of Classification Search
CPC ..... A45C 13/385; A45C 3/00; A45C 13/36
USPC ..... 190/18 A
See application file for complete search history.

(56) References Cited

U.S. PATENT DOCUMENTS 4,637,626 A 1/1987 Foss
12,065,183 B2 * 8/2024 Laudani ..... B62B 3/02
2014/0077468 A1 3/2014 Arnold
2015/0360707 A1 * 12/2015 Gullino ..... B62B 5/0079 280/659
2024/0115024 A1 4/2024 Park

FOREIGN PATENT DOCUMENTS

| | | |
|---|---|---|
| CN | 201923178 U | 8/2011 |
| CN | 206089805 | 4/2017 |
| CN | 210901747 U | 7/2020 |
| CN | 217885330 U | 11/2022 |
| JP | 2021142885 | 9/2021 |
| KR | 20020038673 | 5/2002 |
| WO | WO08401334 | 4/1984 |

OTHER PUBLICATIONS https://www.youtube.com/watch?v=wqiBsL8JGNw by Oneon (Year: 2021).*

* cited by examiner

*Primary Examiner* — Nathan J Jenness
*Assistant Examiner* — Jessica Kavini Tamil

(57) ABSTRACT

A luggage dolly for supporting and moving a luggage article includes a first panel and a second panel, each of which has a top surface, a bottom surface, a front edge surface, a rear edge surface, a pair of side edge surfaces, and a pair of wheels. A coupler is designed to couple the first panel and the second panel to support an end wall of a luggage article. A projection projects from the front edge surface of the first panel. The projection is insertable under a handle loop projecting from the end wall of the luggage article and into engagement with the second panel to secure the first panel and the second panel to the handle loop with ends of the handle loop positioned in a pair of spaces between the front edge surface of the first panel and the front edge surface of the second panel.

16 Claims, 17 Drawing Sheets

LUGGAGE DOLLY FOR SUPPORTING AND MOVING A LUGGAGE ARTICLE, SUCH AS A DUFFEL BAG, AND A METHOD THEREFOR

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to wheeled luggage carriers and more particularly pertains to a new luggage dolly for moving a luggage article. Most luggage articles, such as suitcases, duffel bags, and similar, are difficult to carry by hand, so they often include wheels to permit dragging or towing of the luggage article over a surface, such as ground, pavement, or floors. However, even these wheels can be limited in their use. The small wheels are most suitable for the smooth floors airports and businesses, but can be difficult to use in natural terrain or surfaces with greater friction, like carpet. In addition, very heavy luggage articles can produce heavy forces that resist pulling and could cause damage to the wheels and any supporting structure attached to the luggage article, especially if the luggage article has relatively soft or flexible walls, such as would be used with a fabric duffel bag, for example. The new luggage dolly provides a durable support for luggage articles, such as large duffel bags, for easier transport, which luggage dolly is detachable into two pieces for storage when not in use.

(2) Description of Related Art Including Information Disclosed Under 37 CFR 1.97 and 1.98

The prior art relates to wheeled luggage articles and dollies. The prior art, as best understood, does not disclose a luggage dolly for supporting and moving a luggage article that includes a first panel and a second panel, wherein a projection is attached to and projects from the front edge surface of first panel, which projection is designed to be inserted under a handle loop projecting from the end wall of the luggage article and into engagement with the second panel to secure the first panel and the second panel to the handle loop such that ends of the handle loop are positioned in a pair of spaces between a front edge surface of the first panel and a front edge surface of the second panel. A coupler is also included that is designed to couple the first panel and the second panel to support an end wall of the luggage article is positioned on respective ones of the top surfaces of the first panel and the second panel.

BRIEF SUMMARY OF THE INVENTION

An embodiment of the disclosure meets the needs presented above in a luggage dolly for supporting and moving a luggage article generally comprising a first panel and a second panel. The first panel has a top surface and a bottom surface. The first panel has a front edge surface, a rear edge surface, and a pair of side edge surfaces connecting the front edge surface of the first panel and the rear edge surface of the first panel. A first pair of wheels is coupled to the first panel at the bottom surface of the first panel. The second panel has a top surface and a bottom surface. The second panel has a front edge surface, a rear edge surface, and a pair of side edge surfaces connecting the front edge surface of the second panel and the rear edge surface of the second panel. A second pair of wheels is coupled to the second panel at the bottom surface of the second panel. A coupler is designed to couple the first panel and the second panel to support an end wall of the luggage article is positioned on respective ones of the top surfaces of the first panel and the second panel. A projection is attached to and projects from the front edge surface of first panel. The projection is designed to be inserted under a handle loop projecting from the end wall of the luggage article and into engagement with the second panel to secure the first panel and the second panel to the handle loop such that ends of the handle loop are positioned in a pair of spaces between the front edge surface of the first panel and the front edge surface of the second panel.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
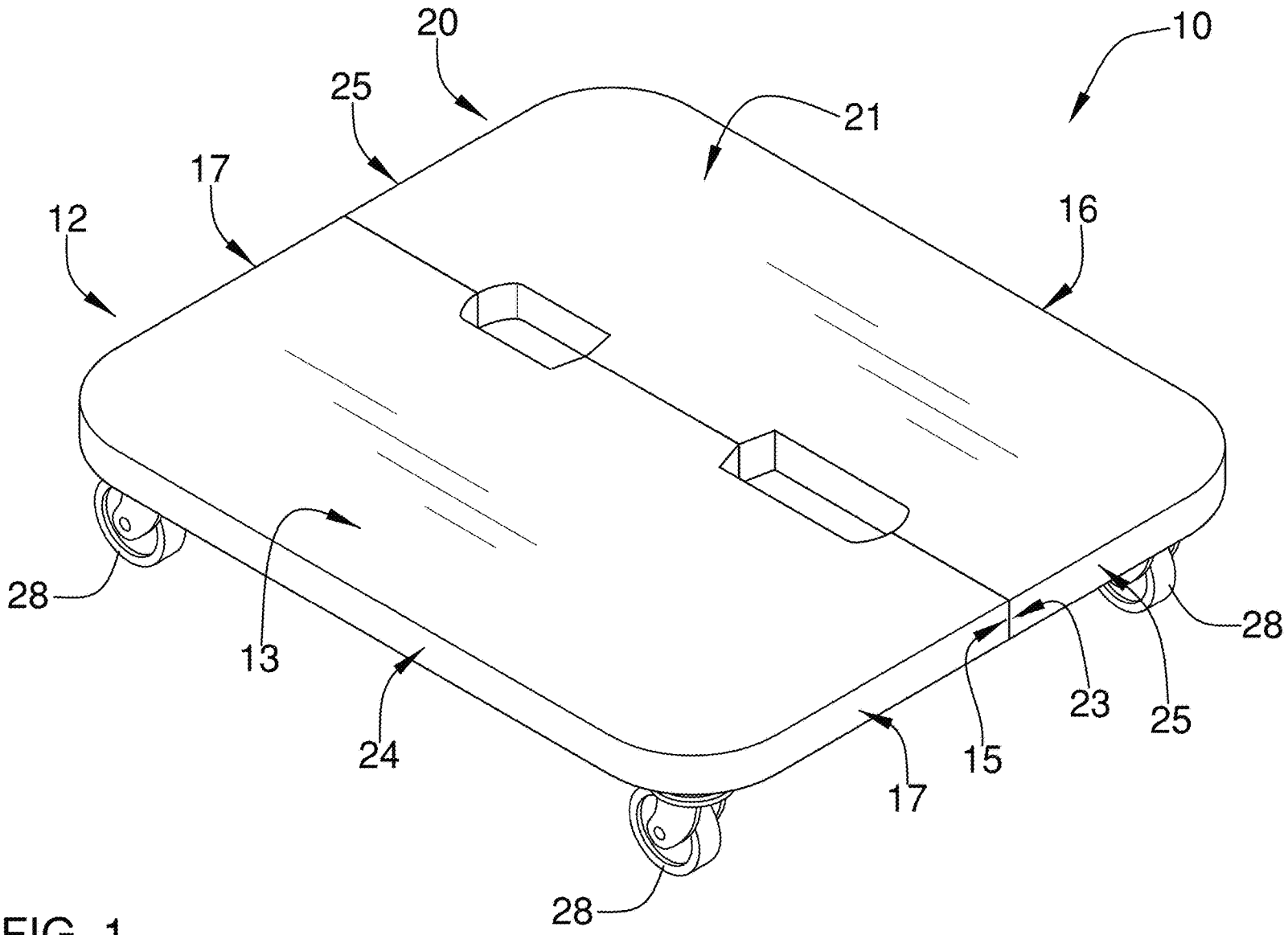
FIG. 1 is a top perspective view of a luggage dolly according to an embodiment of the disclosure.

With reference now to the drawings, and in particular to FIGS. 1 through 21 thereof, a new luggage dolly embodying the principles and concepts of an embodiment of the disclosure and generally designated by the reference numeral 10 will be described.

It should first be noted that FIGS. 1 through 11 show a first exemplary embodiment of the luggage dolly 10. However, it should be noted that this is only one exemplary embodiment, and variations on this design, such as shown in FIGS. 12 through 21, are within the scope of the disclosure. It should also be noted that components of one embodiment may be utilized or adapted for use in one or more of the other embodiments disclosed herein.

As best illustrated in FIGS. 1 through 11, the luggage dolly 10 for supporting and moving a luggage article 70 generally comprises a first panel 12 and a second panel 20. The first panel 12 has a top surface 13 and a bottom surface 14. The first panel 12 has a front edge surface 15, a rear edge surface 16, and a pair of side edge surfaces 17 connecting the front edge surface 15 of the first panel 12 and the rear edge surface 16 of the first panel 12. A first pair of wheels 28 is coupled to the first panel 12 at the bottom surface 14 of the first panel 12. The second panel 20 has a top surface 21 and a bottom surface 22. The second panel 20 has a front edge surface 23, a rear edge surface 24, and a pair of side edge surfaces 25 connecting the front edge surface 23 of the second panel 20 and the rear edge surface 24 of the second panel 20. A second pair of wheels 28 is coupled to the second panel 20 at the bottom surface 22 of the second panel 20. A coupler 30 is designed to couple the first panel 12 and the second panel 20 to support an end wall 71 of the luggage article 70 is positioned on respective ones of the top surfaces 13, 21 of the first panel 12 and the second panel 20. A projection 32 is attached to and projects from the front edge surface 15 of the first panel 12. The projection 32 is designed to be inserted under a handle loop 72 projecting from the end wall 71 of the luggage article 70 and into engagement with the second panel 20 to secure the first panel 12 and the second panel 20 to the handle loop 72 such that ends of the handle loop 72 are positioned in a pair of spaces 38 between the front edge surface 15 of the first panel 12 and the front edge surface 23 of the second panel 20.

With reference to FIGS. 1 through 7, the second panel 20 includes a receptacle 34 designed to receive a portion of the projection 32 of the first panel 12. The receptacle 34 is positioned at the front edge surface 23 of the second panel 20. In this exemplary embodiment, the projection 32 of the first panel 12 includes a pair of stepped portions 33. The receptacle 34 of the second panel 20 includes a pair of slots 35. Each of the slots 35 is designed to receive a respective one of the stepped portions 33. This stepped or shoulder design promotes centering of the projection 32 in the receptacle 34 and stable connection or interlock between the projection 32 and the receptacle 34, and thus a stable connection of the first panel 12 and the second panel 20.

Figure 3:
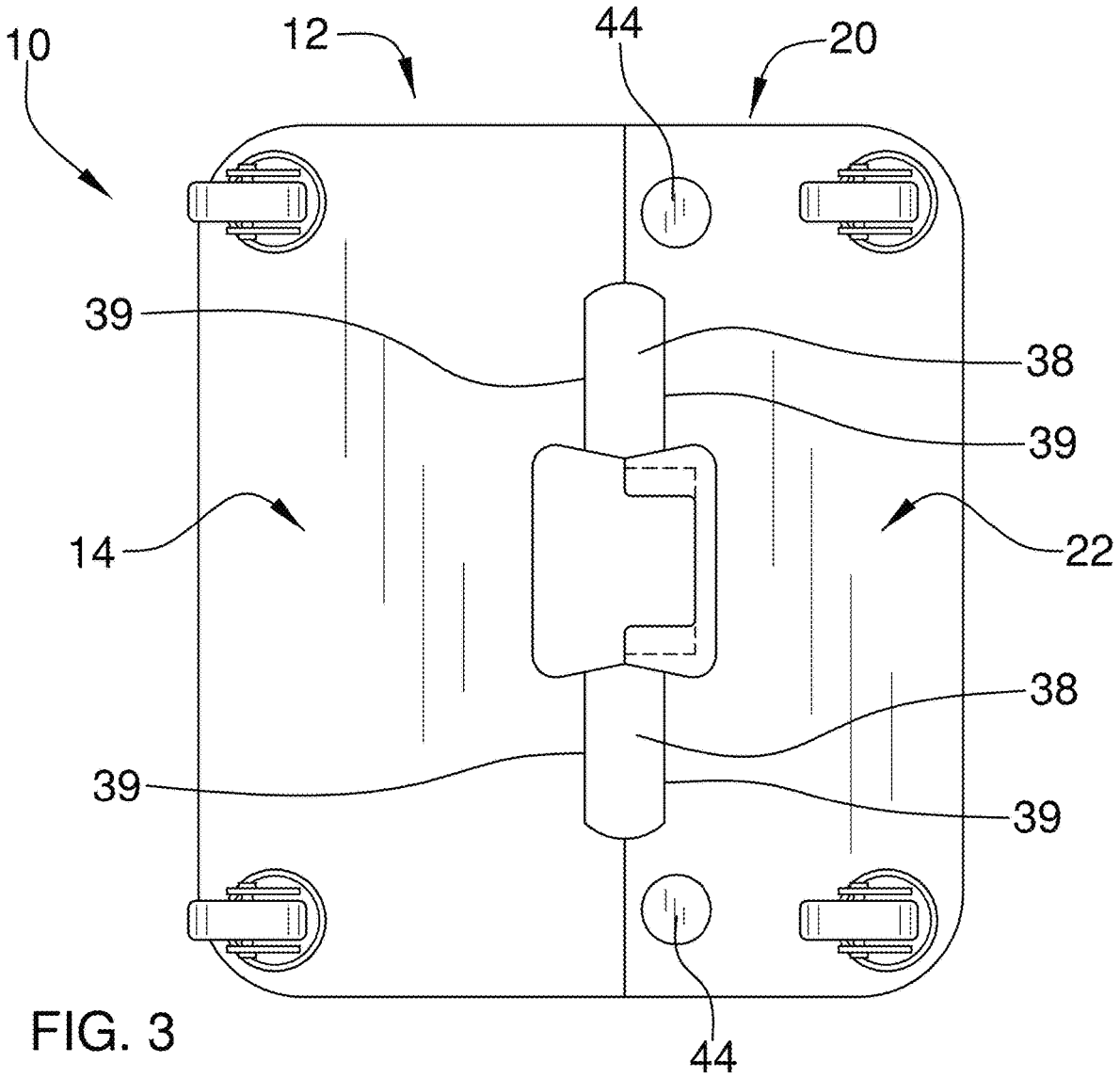
FIG. 3 is a bottom view of an embodiment of the disclosure.
Figure 4:
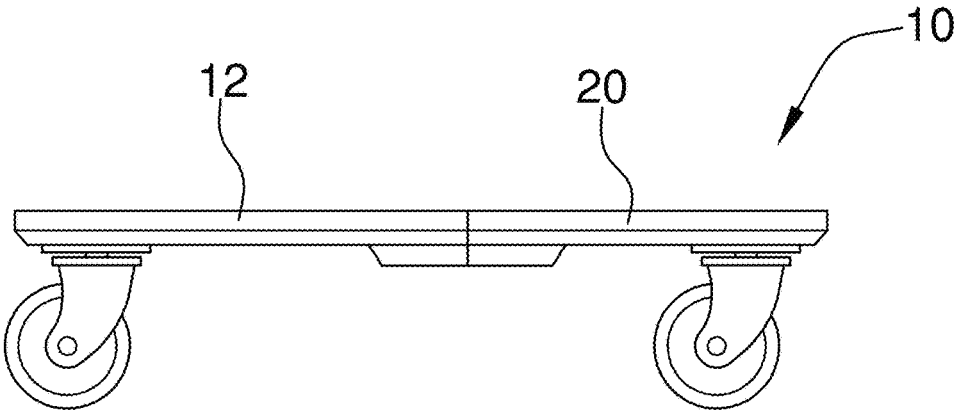
FIG. 4 is a side view of an embodiment of the disclosure.
Figure 5:
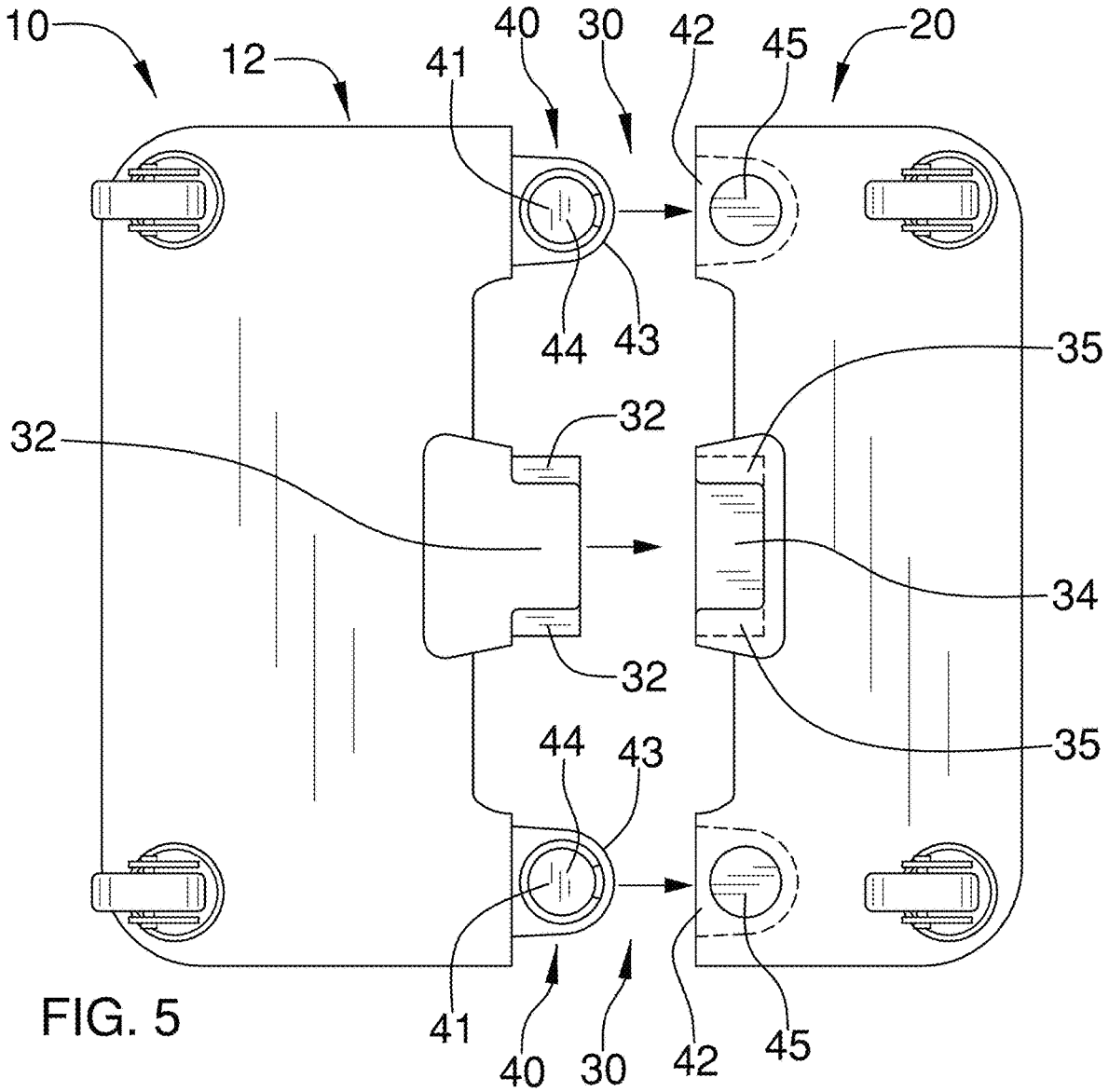
FIG. 5 is a bottom view of an embodiment of the disclosure partially disassembled.
Figure 6:
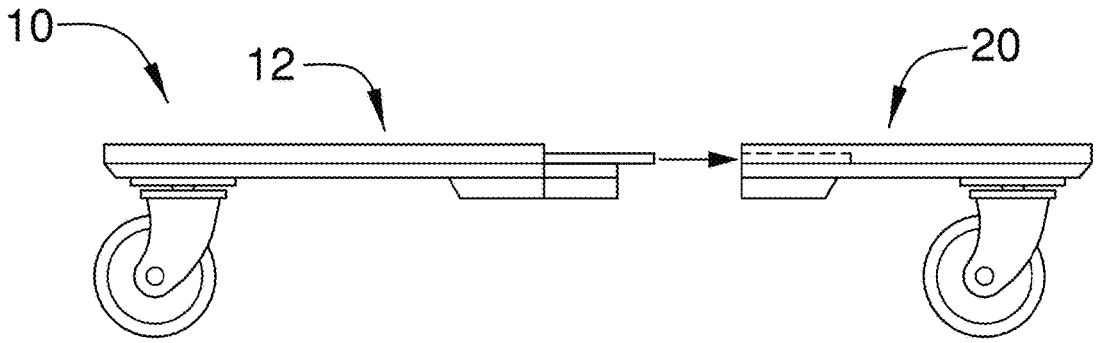
FIG. 6 is a side view of an embodiment of the disclosure partially disassembled.
Figure 10:
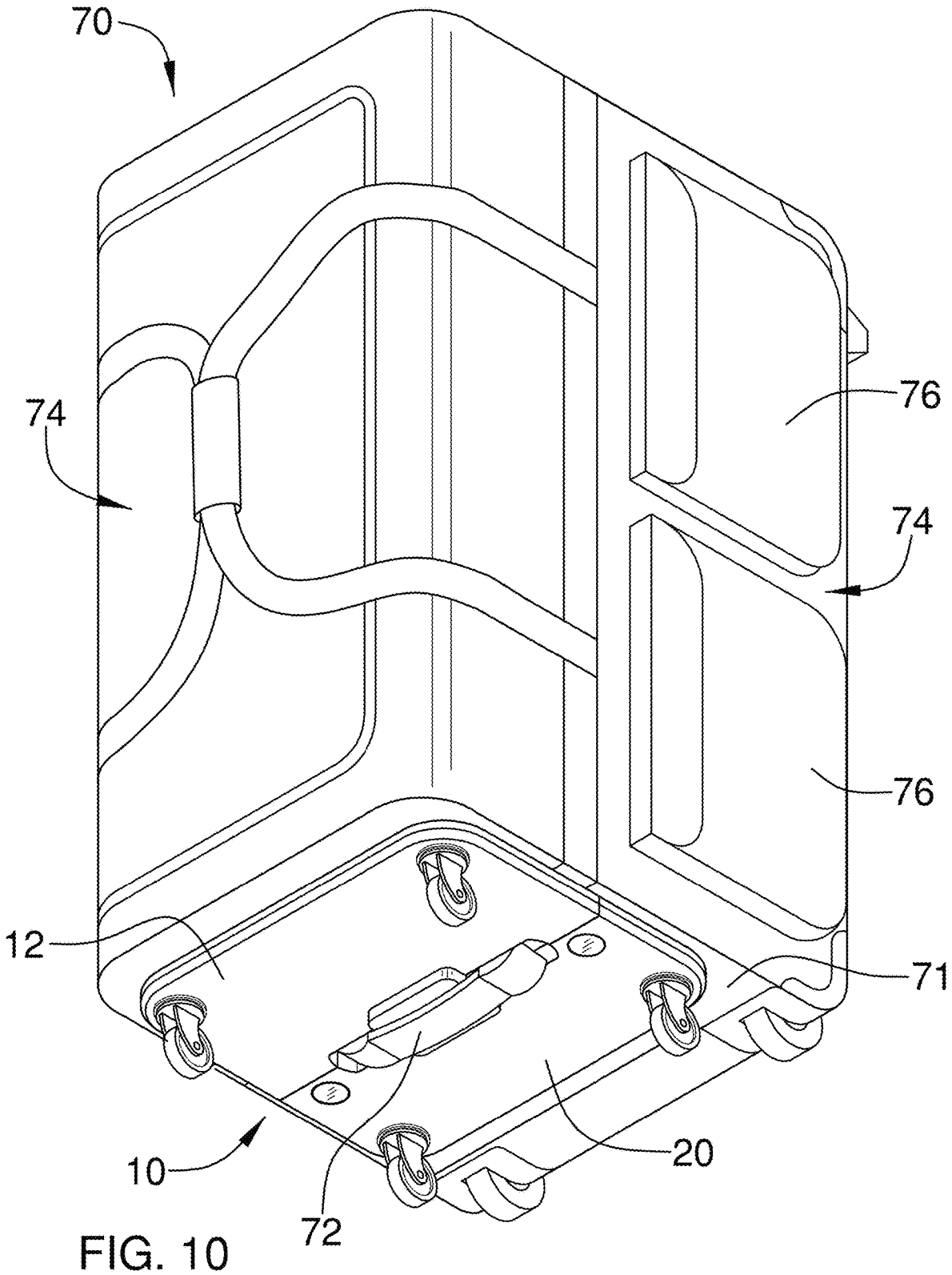
FIG. 10 is a perspective view of an embodiment of the disclosure installed on the luggage article.

The front edge surface 15 of the first panel 12 is positioned parallel to the rear edge surface 16 of the first panel 12. Likewise, the front edge surface 23 of the second panel 20 is positioned parallel to the rear edge surface 24 of the second panel 20. As best shown in FIG. 3, each of the front edge surfaces 15, 23 includes a pair of recessed portions 40 designed to be aligned to form the pair of spaces 38 when the first panel 12 and the second panel 20 are coupled together. The spaces 38 allow the luggage dolly 10 to be coupled around the handle loop 72, as shown in FIG. 10.

Figure 2:
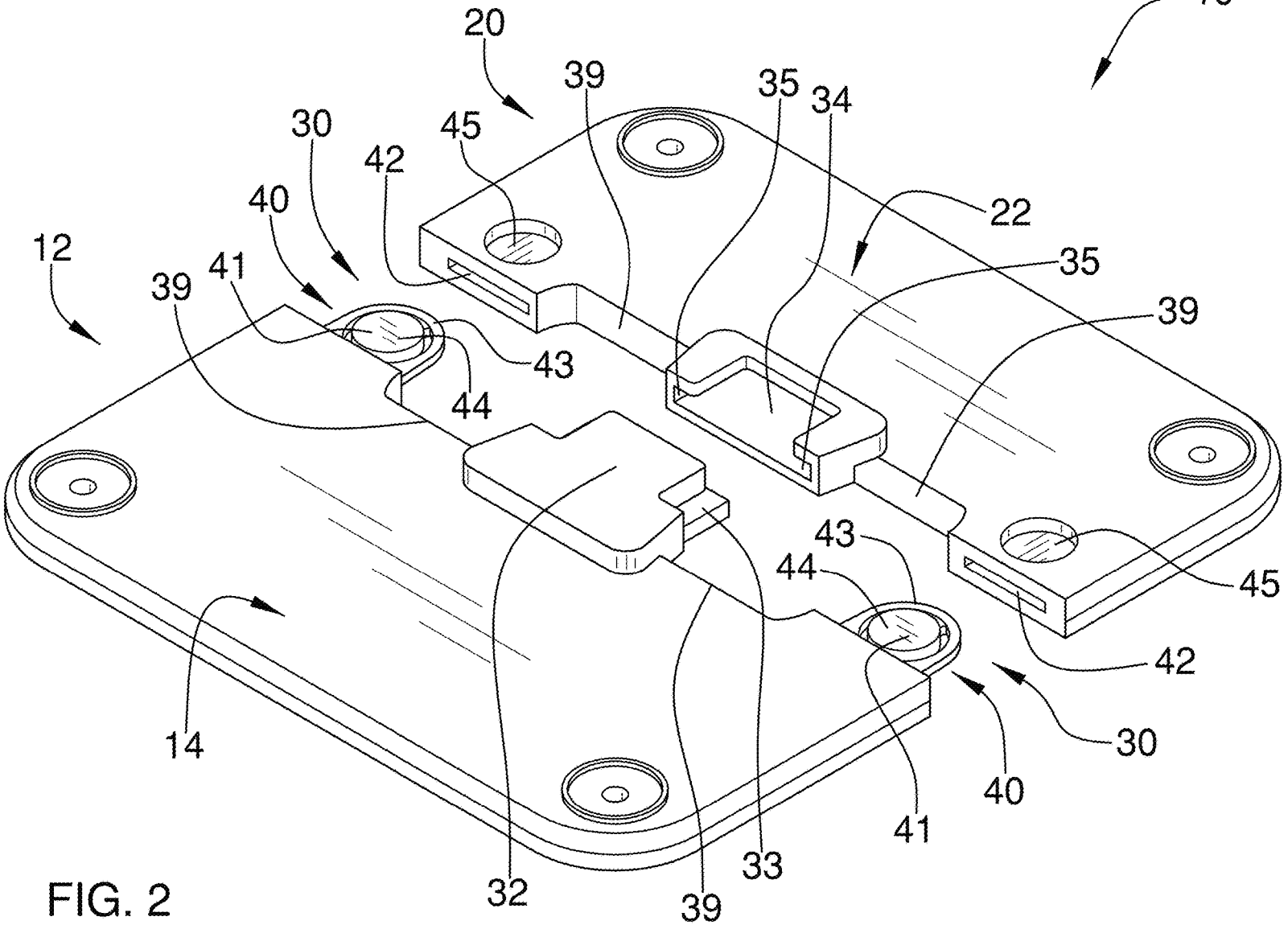
FIG. 2 is a bottom perspective view of an embodiment of the disclosure.

As shown in FIG. 2, the coupler 30 includes a pair of locks 40 positioned on opposite sides of the projection 32. Each of the locks 40 includes a tab 41 attached to and projecting from the front edge surface 15 of the first panel 12 and a pocket 42 positioned at the front edge surface 23 of the second panel 20. The tab 41 is designed to be inserted into and releasably engaged with the pocket 42. In another possible embodiment, the coupler 30 could be a hinge or hinged connection, wherein the first panel 12 is pivotably connected to the second panel 20. For example, the front edge surfaces 15, 23 could be pivotably connected on either side of the recessed portions 40, and the projection 32 could be pivoted into engagement with the second panel 20. In another possible embodiment, a hinge could be located at one of the corners where one of the front edge surfaces 15, 23 meets a corresponding one of side edge surfaces 17, 25, and the first panel 12 and the second panel 20 could swing back and forth like a pair of jaws.

In this exemplary embodiment in FIGS. 1 through 7, the tab 41 includes a frame 43 and a button 44 pivotably attached to the frame 43. The pocket 42 includes an aperture 45 positioned in a side of the pocket 42 at the bottom surface 22 of second panel 20. The button 44 is designed to be resiliently displaced when the tab 41 is partially inserted into the pocket 42 and to snap back and into the aperture 45 when the tab 41 is fully inserted into the pocket 42, such that the button 44 is selectively pressable to disconnect the tab 41 from the pocket 42. This snap-fit design of the locks 40 allows for relatively easy connection and disconnection.

Other types of locking connections could be used, such as clamps, clasps, interlocking pieces, and interlocking teeth, in other possible embodiments.

Figure 7:
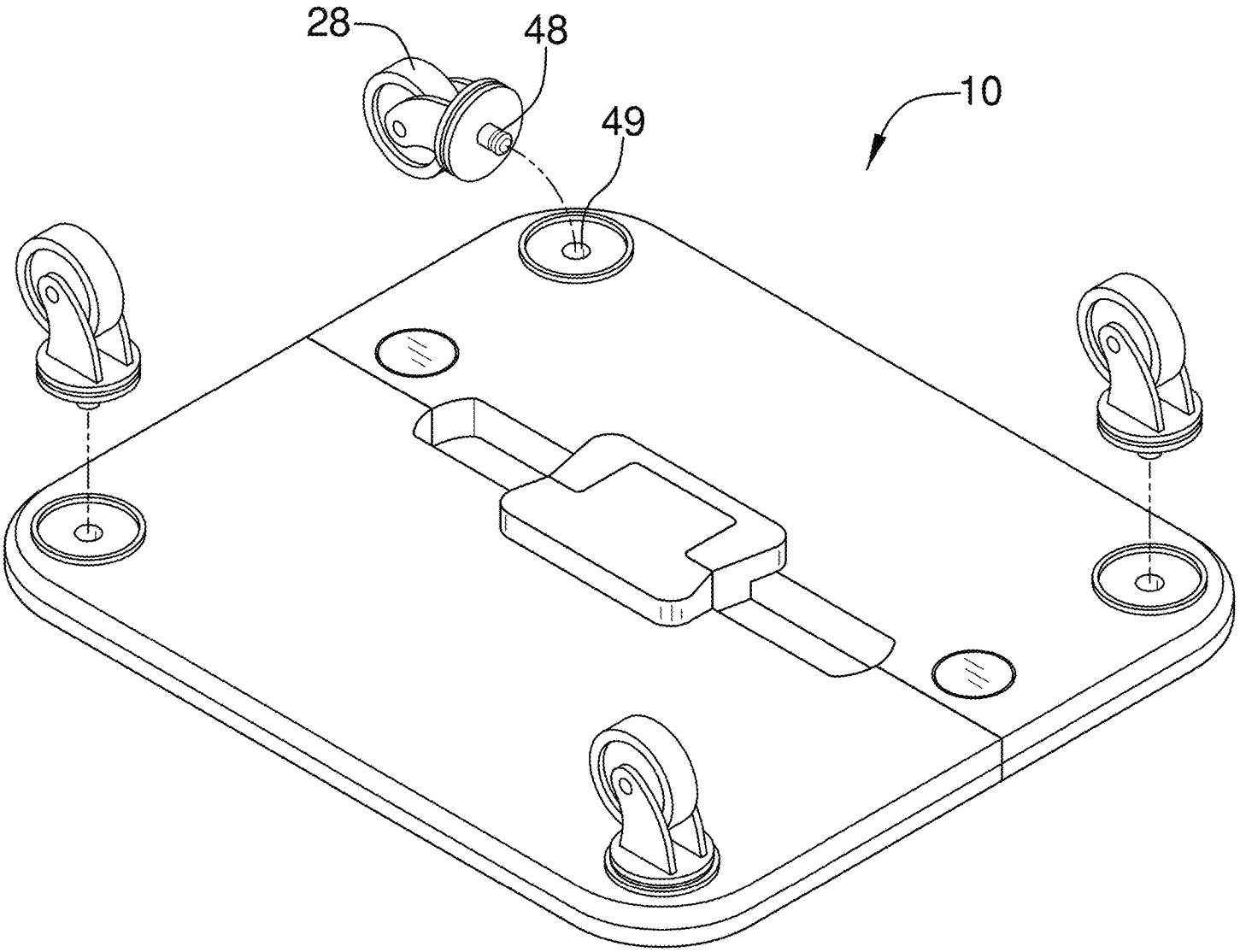
FIG. 7 is a bottom perspective view of an embodiment of the disclosure partially disassembled.

As shown in FIG. 7, each of the wheels 28 is detachably coupled to its respective one of the first panel 12 and the second panel 20. The detachability can be accomplished in a manner well known in the transport arts, such as by a friction fit between an axle 48 and a contoured tube 49 as shown in FIG. 7. Each of the wheels 28 is in the form of a caster rotatably mounted to its respective one of the first panel 12 and the second panel 20. As is well known in the transport arts, casters are freely rotatable for maximum freedom of translating movement in different directions on a surface. Each of the wheels 28 in FIGS. 1 through 11 is a single-wheel caster, whereas in the alternative embodiments in FIGS. 12 through 21, the wheels 28 are double-wheel casters. In another possible embodiment, the wheels 28 could be rather large or oversized, like those used for strollers or wagons, to better traverse rough terrain.

Figure 8:
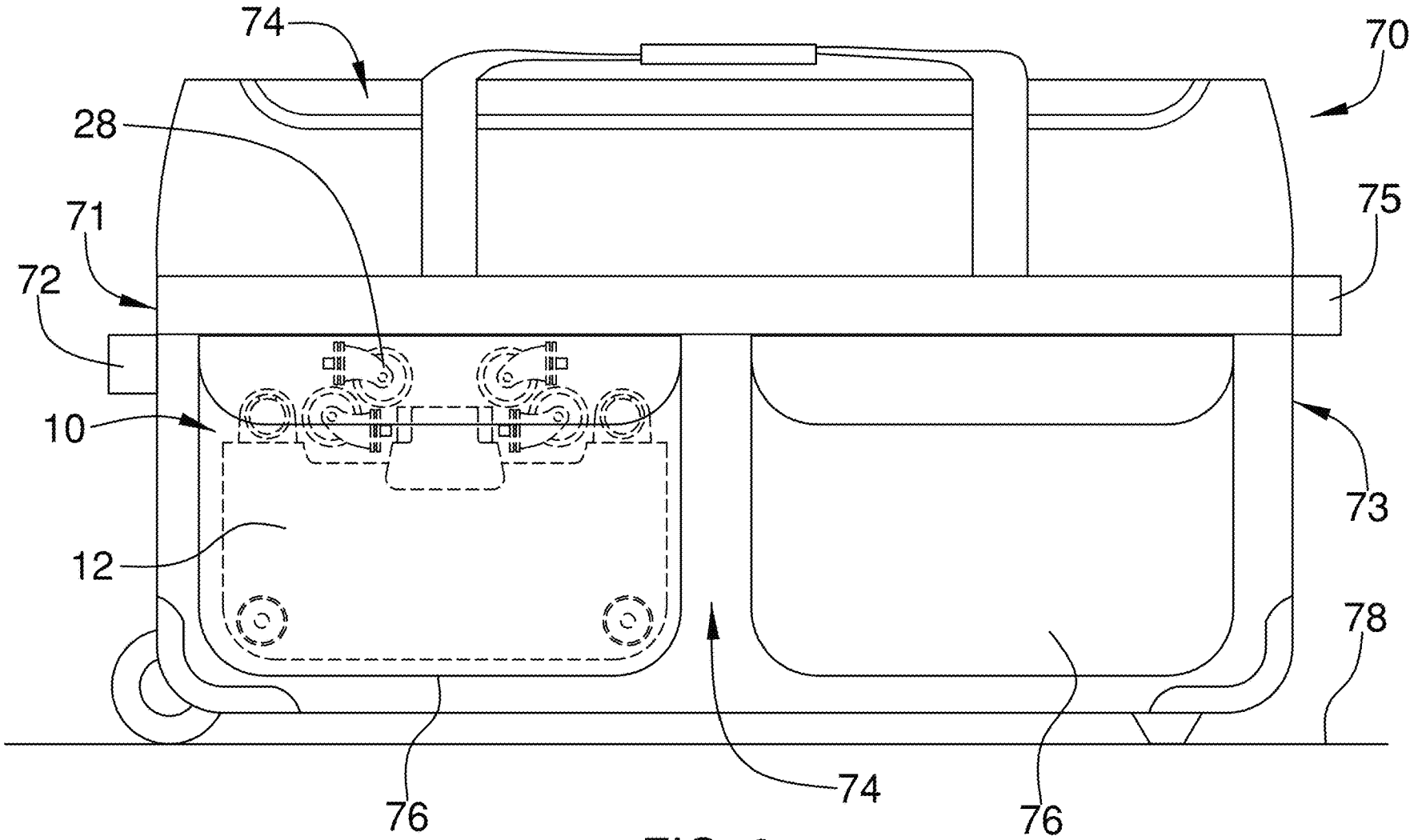
FIG. 8 is a side view of an embodiment of the disclosure disassembled in a storage position in a luggage article.
Figure 9:
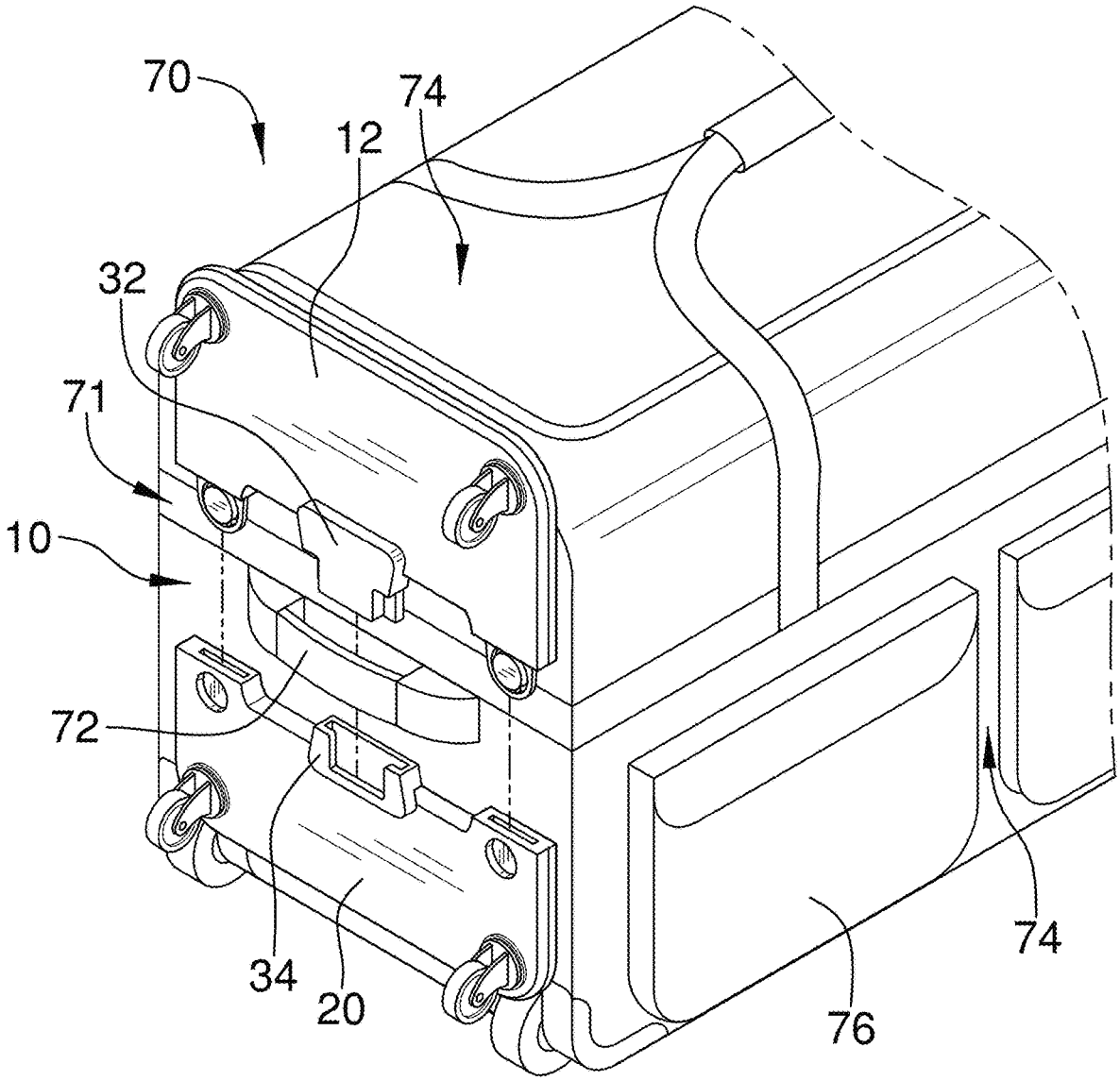
FIG. 9 is a perspective view of an embodiment of the disclosure being installed on the luggage article.
Figure 11:
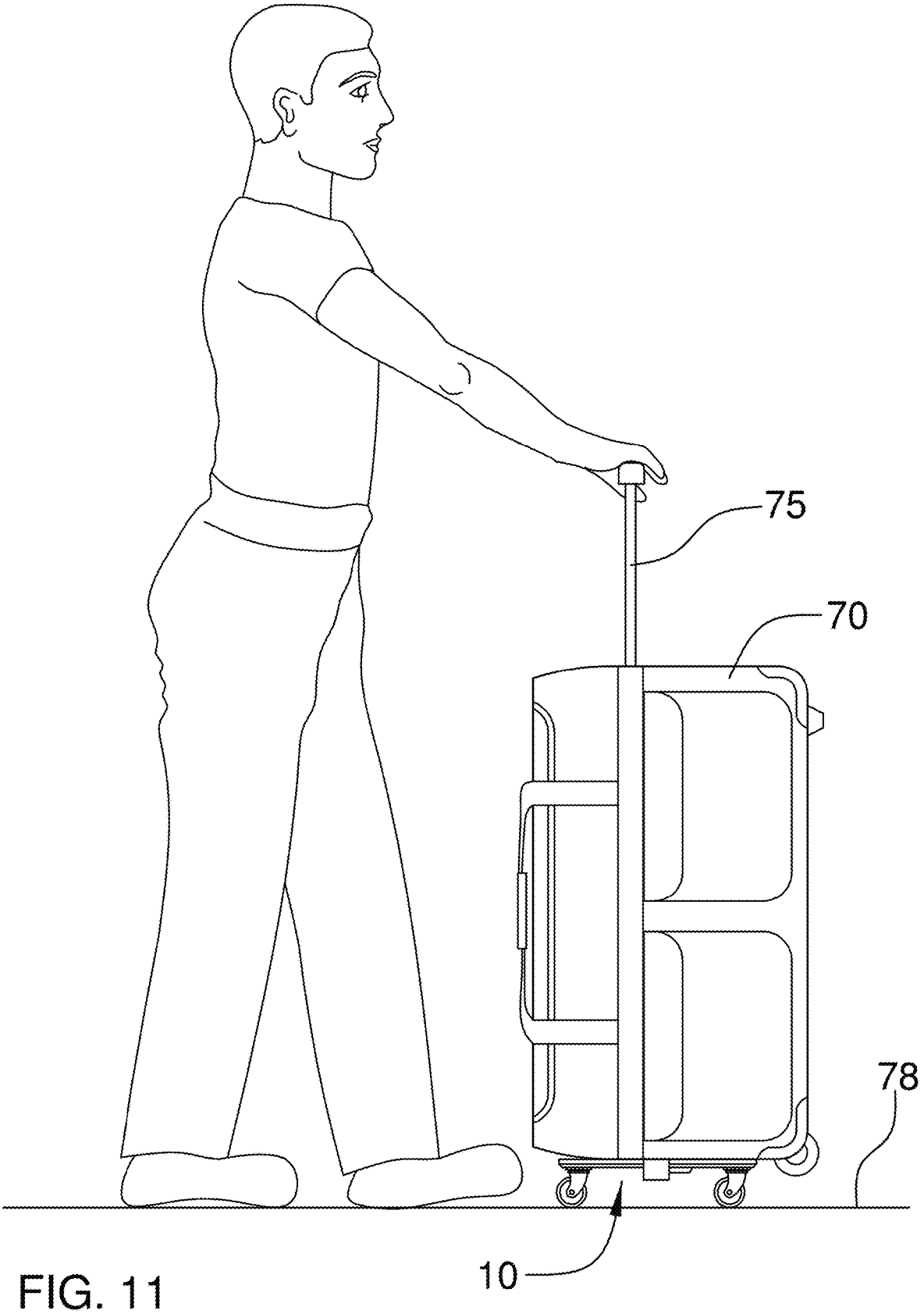
FIG. 11 is a side view of an embodiment of the disclosure in use with the luggage article.
Figure 12:
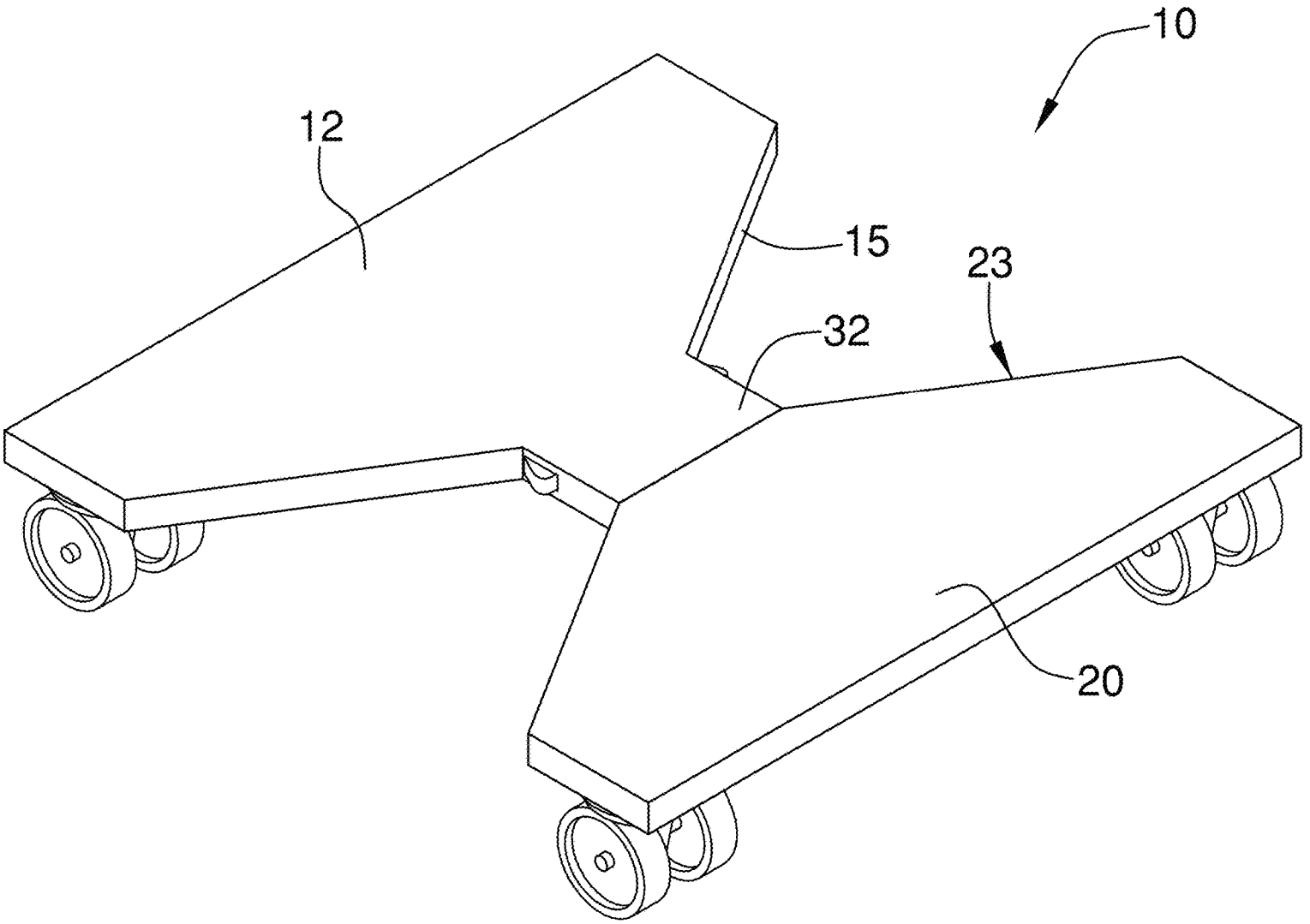
FIG. 12 is a top perspective view of an alternative embodiment of the disclosure.

FIGS. 8 through 11 show the use of the luggage dolly 10, specifically the embodiment shown in FIGS. 1 through 7, though the operating principles are equally applicable to any of the other embodiments. With reference to FIGS. 9 and 10, a user first orients the top surface 13 of the first panel 12 and the top surface 21 of the second panel 20 to face toward an end wall 71 of a luggage article 70, in this case a duffel bag, though the luggage dolly 10 could be used with other luggage articles 70 that have an end wall 71 that includes a handle loop 72. The user then inserts the projection 32 of the first panel 12 into the handle loop 72 of the end wall 71 of the luggage article 70 and into engagement with the second panel 20. The user essentially simultaneously couples the first panel 12 to the second panel 20 with the coupler 30. Once fully connected, the buttons 44 project through the apertures 45 in a snap-fit connection. The user then places the luggage dolly 10 with the wheels 28 on a support surface 78 and with the luggage article 70 supported on the top surface 13 of the first panel 12 and the top surface 21 of the second panel 20, as shown in FIG. 11. The user can now handle the luggage article 70 and move the luggage article 70 and the luggage dolly 10. When finished moving the luggage article 70, the user can detach the first panel 12 and the second panel 20 and remove the first panel 12 and the second panel 20 from the luggage article 70.

As mentioned above, the luggage article 70 can be a duffel bag, herein after referred to with the same reference numeral 70 for convenience. The duffel bag 70 shown in the figures is in the shape of a rectangular prism and includes the end wall 71, an opposite end wall 73, and elongated perimeter walls 74 perpendicular to and connecting the end wall 71 and the opposite end wall 73. The duffel bag 70 is reinforced, such as by an inner framework, to generally maintain the shape of the duffel bag 70. A tow handle 75 is positioned at the opposite end wall 73. The reinforced design allows the duffel bag 70 to maintain its shape when oriented vertically on the end wall 71, rather than collapsing like a flexible bag that is not reinforced. As shown in FIG. 11, the user can grasp the tow handle 75 and move the duffel bag 70 and the luggage dolly 10 with the duffel bag 70 oriented vertically. The weight of the duffel bag 70 is now completely supported by the luggage dolly 10, thereby allowing even persons of reduced strength, such as the elderly or children, to be able to move the duffel bag 70 around.

As shown in FIG. 8, the duffel bag 70 includes a side pocket 76 positioned on one of the elongated perimeter walls 74. Each of the first panel 12 and the second panel 20 is designed to fit into the side pocket 76 of the luggage article 70 for storage and transport. For example, if the user is checking the duffel bag 70 at an airport, the user can disassemble the luggage dolly 10 and insert the first panel 12, the second panel 20, and the wheels 28 in the side pocket 76 for storage.

FIGS. 12 through 17 show one possible alternative embodiment in which the first panel 12 and the second panel 20 have a generally trapezoidal shape, wherein the front edge surfaces 15, 23 taper to the middle. The projection 32 has two passages 55 designed to receive two snap-fit legs 56 projecting out of the front edge surface 23 of the second panel 20. The legs 56 project out of the sides of the projection 32 in order to be pressed inwardly to disconnect the first panel 12 and the second panel 20.

Figure 18:
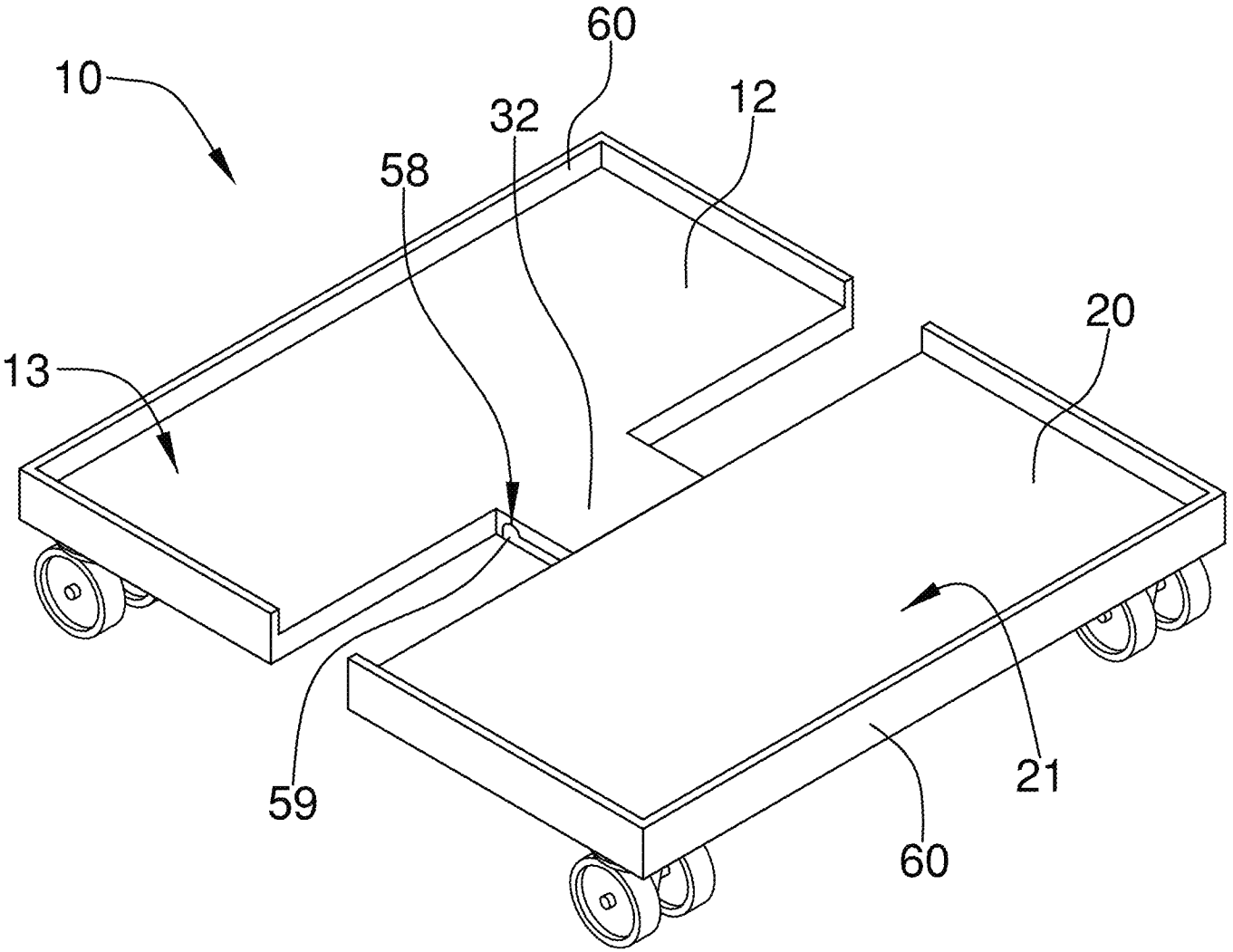
FIG. 18 is a top perspective view of an alternative embodiment of the disclosure.

FIG. 18 shows another possible alternative embodiment in which the projection 32 has a groove 58. The coupler 30 is in the form of a tongue 59 projecting from the second panel 20 that engages in the groove 58 in a form and friction fit to lock the first panel 12 and the second panel 20 together. In addition, this embodiment shows that each of the first panel 12 and the second panel 20 can include a perimeter lip 60 projecting from the top surfaces 13, 21. The perimeter lip 60 could be incorporated into any of the embodiments disclosed herein.

Figure 19:
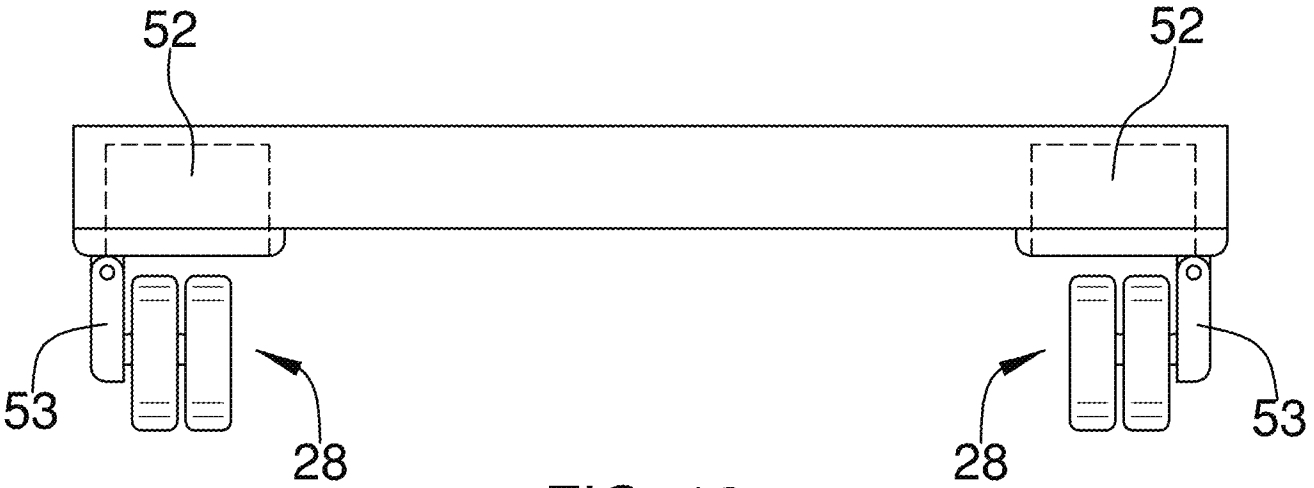
FIG. 19 is an end view of an alternative embodiment of the disclosure.
Figure 20:
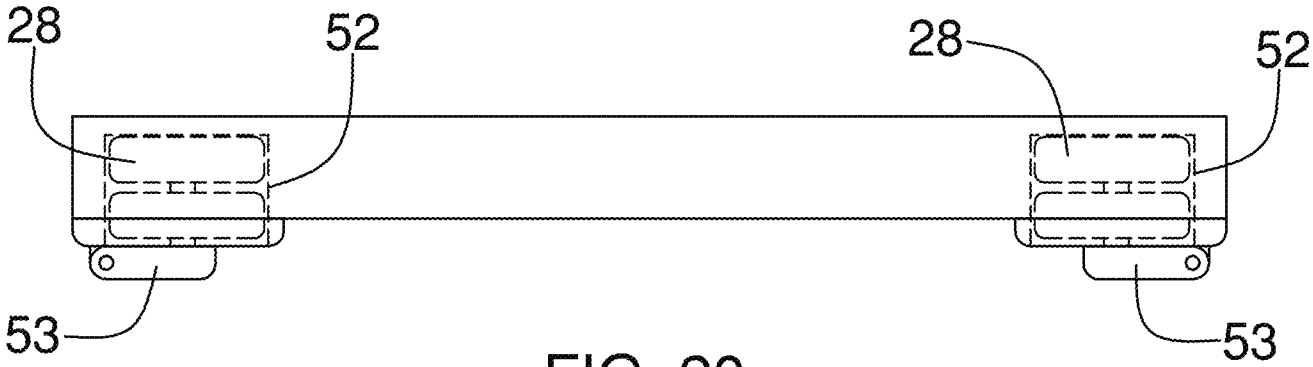
FIG. 20 is an end view of the alternative embodiment of the disclosure in FIG. 19.

FIGS. 19 and 20 show an alternative design of the wheels 28, wherein each of the first panel 12 and the second panel 20 includes a pair of wheel wells 52, much like on an airplane. Each of the wheels 28 is rotatably mounted on a pivot leg 53 pivotably connected to its respective one of the first panel 12 and the second panel 20. Each of the wheels 28 is selectively pivotable into a respective one of the wheel wells 52 for storage. Therefore, instead of removing the wheels 28, the wheels 28 may be tucked into a storage position when not in use.

Figure 13:
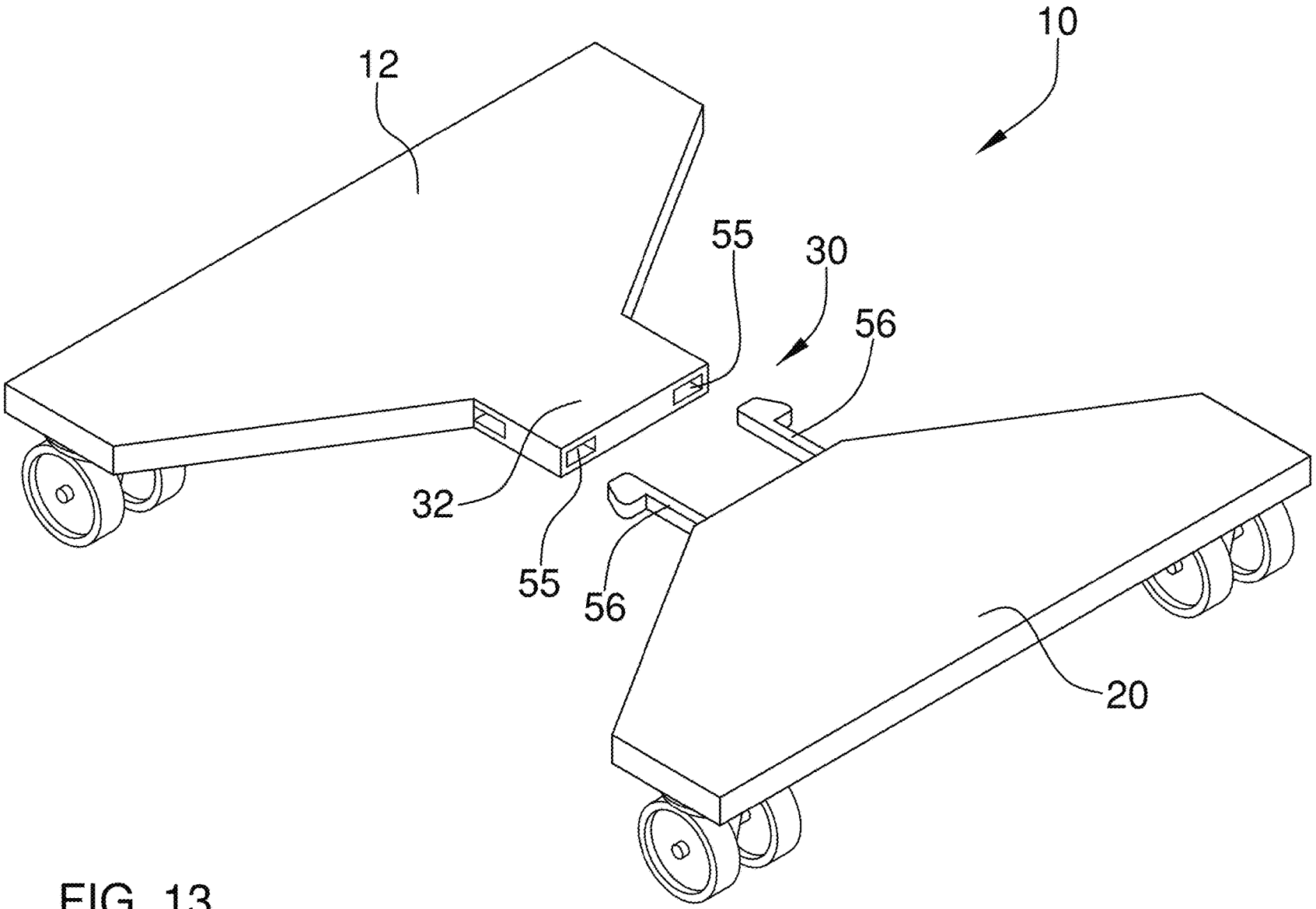
FIG. 13 is a top perspective view of the alternative embodiment of the disclosure shown in FIG. 12 partially disassembled.
Figure 14:
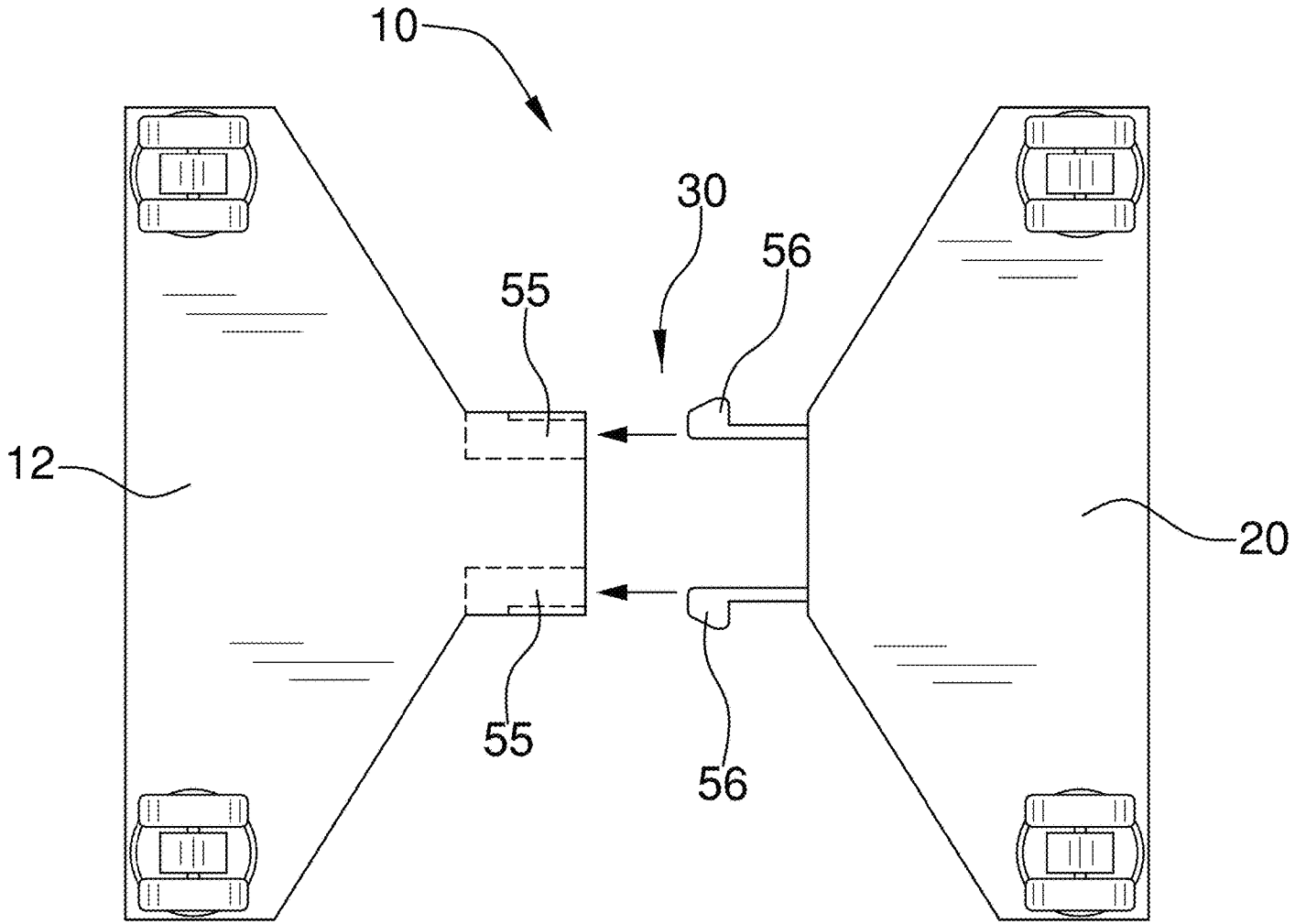
FIG. 14 is a bottom view of the alternative embodiment of the disclosure shown in FIG. 12 partially disassembled.
Figure 15:
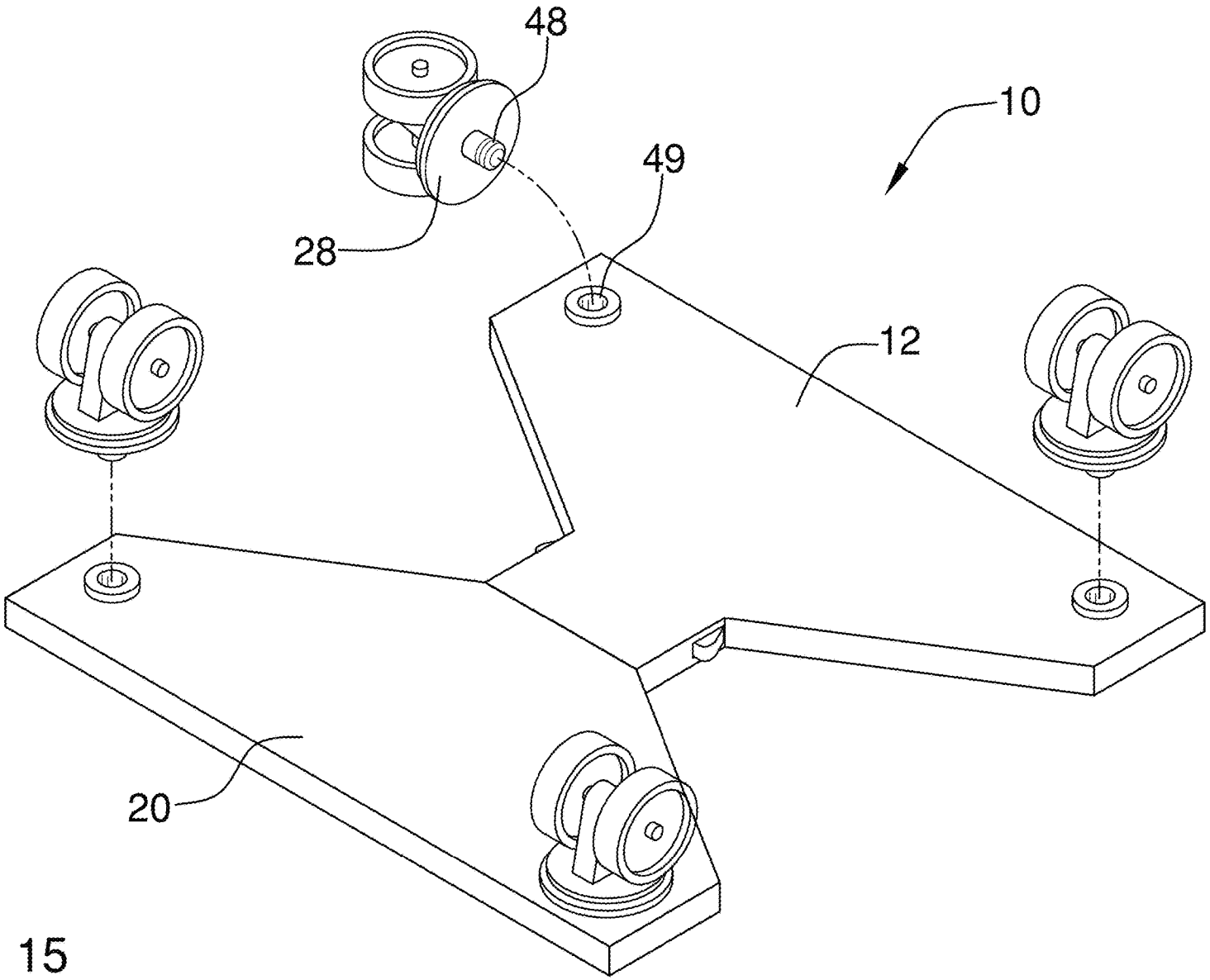
FIG. 15 is a bottom perspective view of the alternative embodiment of the disclosure shown in FIG. 12 partially disassembled.
Figure 16:
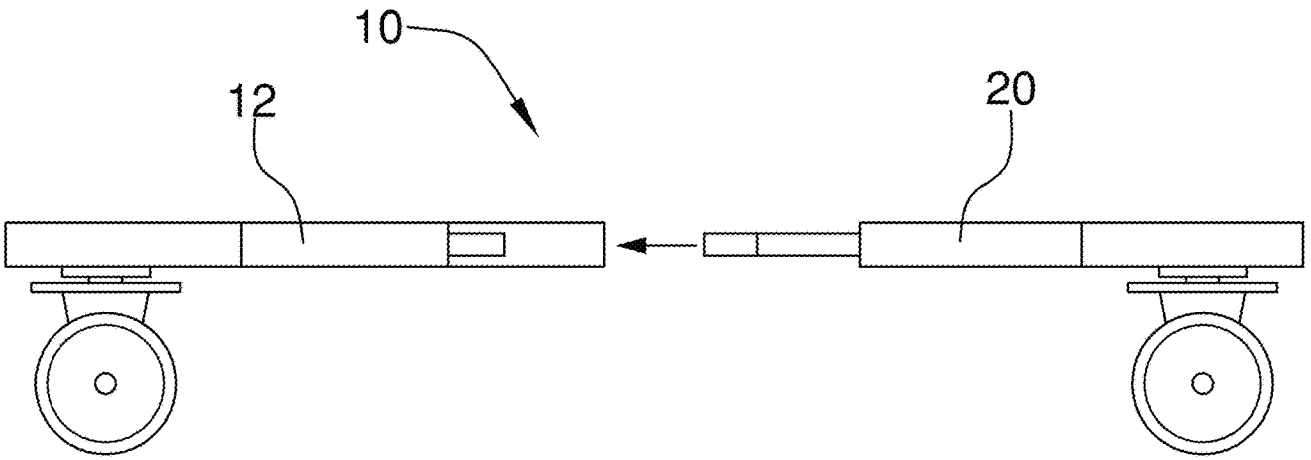
FIG. 16 is a side view of the alternative embodiment of the disclosure shown in FIG. 12 partially disassembled.
Figure 17:
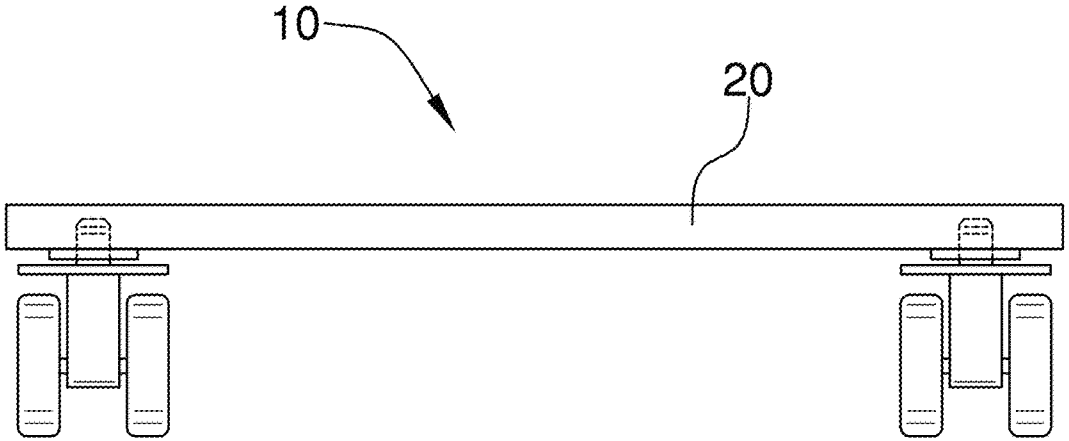
FIG. 17 is an end view of the alternative embodiment of the disclosure shown in FIG. 12.
Figure 21:
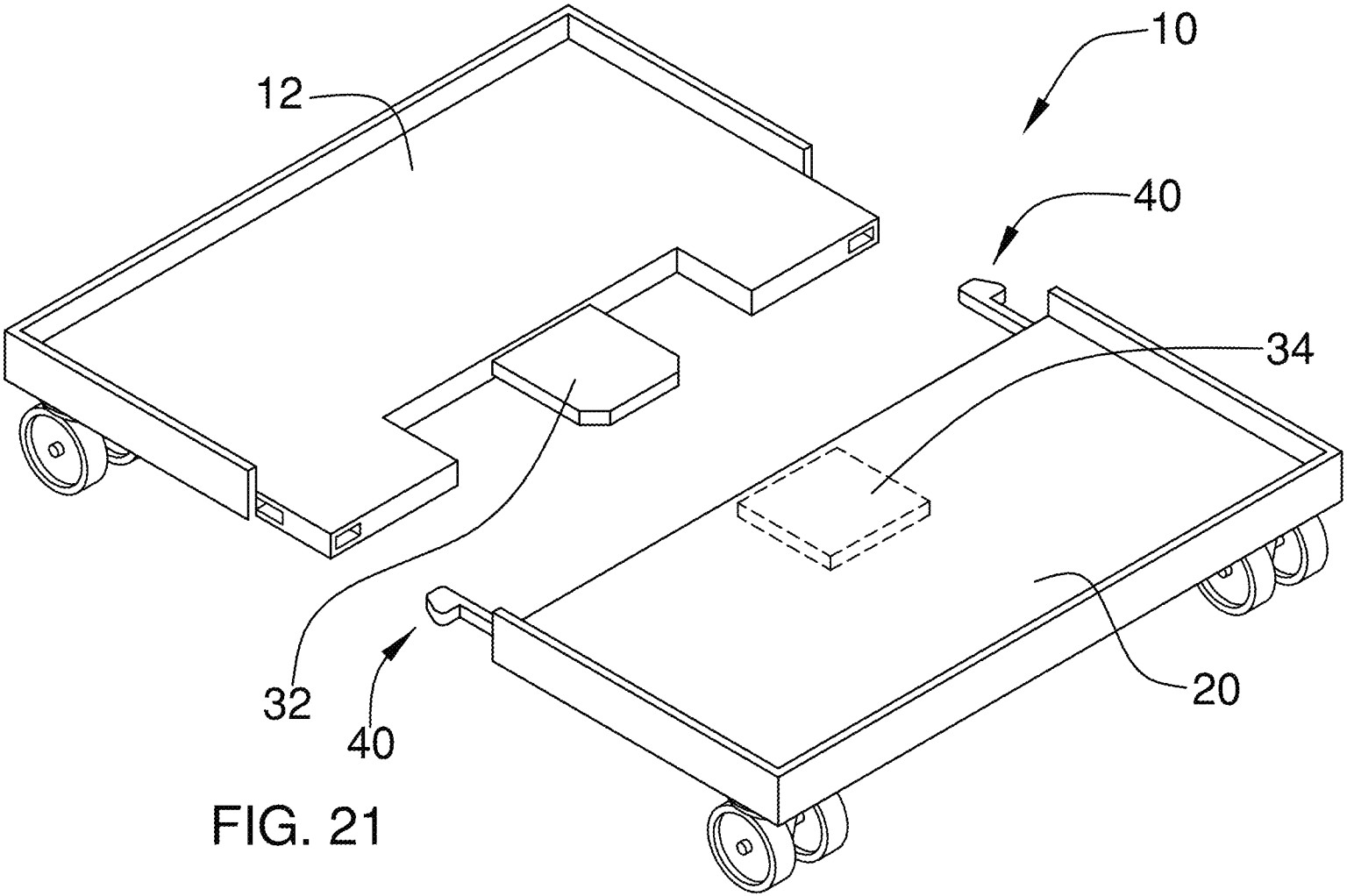
FIG. 21 is a top exploded view of an alternative embodiment of the disclosure.

FIG. 21 shows yet another possible alternative embodiment. In this version, the projection 32 is partially insertable into the receptacle 34 in the second panel 20, but does not include any formed or interlocking parts or surfaces. Each of the locks 40 is a snap-fit design of a similar fashion as shown in FIGS. 13 and 14.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

We claim:

1. A luggage dolly for supporting and moving a luggage article comprising:

a first panel having a top surface and a bottom surface, said first panel having a front edge surface, a rear edge surface, and a pair of side edge surfaces connecting said front edge surface of said first panel and said rear edge surface of said first panel;

a first pair of wheels being coupled to said first panel at said bottom surface of said first panel;

a second panel having a top surface and a bottom surface, said second panel having a front edge surface, a rear edge surface, and a pair of side edge surfaces connecting said front edge surface of said second panel and said rear edge surface of said second panel;

a second pair of wheels being coupled to said second panel at said bottom surface of said second panel;

a coupler being configured to couple said first panel and said second panel to support an end wall of a luggage article positioned on respective ones of said top surfaces of said first panel and said second panel; and a projection being attached to and projecting from said front edge surface of said first panel, said projection being configured to be inserted under a handle loop projecting from the end wall of the luggage article and into engagement with said second panel to secure said first panel and said second panel to the handle loop such that ends of the handle loop are positioned in a pair of spaces between said front edge surface of said first panel and said front edge surface of said second panel.

2. The luggage dolly of claim 1, wherein said second panel includes a receptacle configured to receive a portion of said projection of said first panel, said receptacle is positioned at said front edge surface of said second panel.

3. The luggage dolly of claim 2, wherein:

said projection of said first panel includes a pair of stepped portions;

said receptacle of said second panel includes a pair of slots; and each of said slots is configured to receive a respective one of said stepped portions.

4. The luggage dolly of claim 3, wherein:

said coupler includes a pair of locks positioned on opposite sides of said projection;

each of said locks includes a tab attached to and projecting from said front edge surface of said first panel and a pocket positioned at said front edge surface of said second panel;

said tab is configured to be inserted into and releasably engaged with said pocket;

said tab includes a frame and a button pivotably attached to said frame;

said pocket includes an aperture positioned in a side of said pocket at said bottom surface of second panel; and said button is configured to be resiliently displaced when said tab is partially inserted into said pocket and to snap back and into said aperture when said tab is fully inserted into said pocket, such that said button is selectively pressable to disconnect said tab from said pocket.

5. The luggage dolly of claim 1, wherein said coupler includes a pair of locks positioned on opposite sides of said projection.

6. The luggage dolly of claim 5, wherein:

each of said locks includes a tab attached to and projecting from said front edge surface of said first panel and a pocket positioned at said front edge surface of said second panel; and said tab is configured to be inserted into and releasably engaged with said pocket.

7. The luggage dolly of claim 6, wherein:

said tab includes a frame and a button pivotably attached to said frame;

said pocket includes an aperture positioned in a side of said pocket at said bottom surface of second panel; and said button is configured to be resiliently displaced when said tab is partially inserted into said pocket and to snap back and into said aperture when said tab is fully inserted into said pocket, such that said button is selectively pressable to disconnect said tab from said pocket.

8. The luggage dolly of claim 1, wherein each of said wheels is detachably coupled to its respective one of said first panel and said second panel.

9. The luggage dolly of claim 1, wherein each of said wheels is a caster rotatably mounted to its respective one of said first panel and said second panel.

10. The luggage dolly of claim 1, wherein:

each of said first panel and said second panel includes a pair of wheel wells;

each of said wheels is rotatably mounted on a pivot leg pivotably connected to its respective one of said first panel and said second panel; and each of said wheels is selectively pivotable into a respective one of said wheel wells for storage.

11. The luggage dolly of claim 1, wherein:

said front edge surface of said first panel is positioned parallel to said rear edge surface of said first panel;

said front edge surface of said second panel is positioned parallel to said rear edge surface of said second panel; and each of said front edge surfaces includes a pair of recessed portions configured to be aligned to form said pair of spaces when said first panel and said second panel are coupled together.

12. The luggage dolly of claim 1, wherein each of said first panel and said second panel is configured to fit into a side pocket of the luggage article for storage and transport.

13. The luggage dolly of claim 1, wherein each of said first panel and said second panel includes a perimeter lip projecting from said top surface.

14. The luggage dolly of claim 1, wherein:

each of said wheels is detachably coupled to its respective one of said first panel and said second panel; and each of said wheels is a caster rotatably mounted to its respective one of said first panel and said second panel.

15. The luggage dolly of claim 14, wherein:

said front edge surface of said first panel is positioned parallel to said rear edge surface of said first panel;

said front edge surface of said second panel is positioned parallel to said rear edge surface of said second panel; and each of said front edge surfaces includes a pair of recessed portions configured to be aligned to form said pair of spaces when said first panel and said second panel are coupled together.

16. The luggage dolly of claim 15, wherein each of said first panel and said second panel is configured to fit into a side pocket of the luggage article for storage and transport.

* * * * *